United States Patent [19]

Nomura et al.

[11] Patent Number: 4,901,659

[45] Date of Patent: Feb. 20, 1990

[54] PATTERN-MATCHING SEWING MACHINE

[75] Inventors: Etsuzo Nomura; Hirokazu Takeuchi; Shigeru Suzuki; Kazunori Irie; Hirosumi Itoh, all of Aichi, Japan

[73] Assignee: Brother Kogyo Kabushiki Kaisha, Aichi, Japan

[21] Appl. No.: 302,766

[22] Filed: Jan. 27, 1989

[30] Foreign Application Priority Data

Jan. 28, 1988 [JP] Japan ..... 63-17694

[51] Int. Cl.[4] ..... D05B 27/06; D05B 27/08

[52] U.S. Cl. ..... 112/314; 112/121.11; 112/320

[58] Field of Search ..... 112/314, 313, 306, 320, 112/312, 315, 121.11, 121.12, 121.26, 153, 272; 250/559, 548, 226

[56] References Cited

U.S. PATENT DOCUMENTS

| | | | |
|---|---|---|---|
| 4,526,116 | 7/1985 | Mannel | 112/121.12 X |
| 4,612,867 | 9/1986 | Rösch et al. | 112/314 |
| 4,757,773 | 7/1988 | Nomura et al. | 112/121.11 |
| 4,766,828 | 8/1988 | Nomura et al. | 112/320 X |
| 4,777,896 | 10/1988 | Nomura | 112/320 X |

*Primary Examiner*—Peter Nerbun

*Attorney, Agent, or Firm*—Oliff & Berridge

[57] ABSTRACT

A pattern-matching sewing machine for sewing two sheets, (e.g. two cloths) having the same patterns with their patterns matching. The sewing machine has a plurality of mismatch calculation modes. The operator selects one of the calculation modes appropriate to the type or characteristics of the pattern to be sewn and the mismatch distance is calculated according to the selected mode.

14 Claims, 19 Drawing Sheets

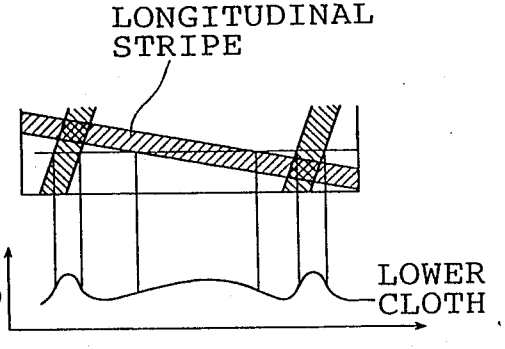
FIG. 11B
FIG. 11D
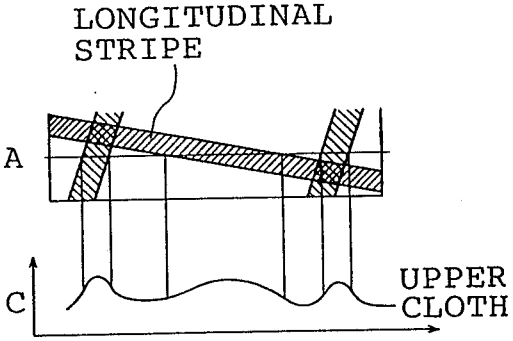
FIG. 11A
FIG. 11C

DIFFERENTIATED

PATTERN-MATCHING SEWING MACHINE

BACKGROUND OF THE INVENTION

This invention relates to a pattern-matching sewing machine for sewing two sheets, such as cloths, each bearing the same patterns, with the patterns matched.

Published Unexamined Japanese Patent Application No. S60-153896 (which corresponds to the U.S. Pat. No. 4,612,867, and the German Patent Application DE 33 46 163 C1) discloses a pattern-matching sewing machine of this type. In this machine, a photo-sensor is placed before the sewing point to generate intensity data representing the brightness of the patterns on the two cloths. The mismatch distance of the patterns on the two cloths is detected using the intensity data, and the relative feed amount of the two cloths is adjusted according to the mismatch distance to maintain the pattern matching of the two cloths.

A problem is that there are patterns that cannot be correctly adjusted by using the brightness alone. An example is a pattern including a foreground pattern of chromatic color with a low brightness (e.g., dark green) on a background pattern of a bright achromatic color and a dark achromatic color (e.g., white and black). In this case, the conventional pattern sensing method cannot accurately recognize the low-brightness chromatic color (dark green) because it is obscured by the bright achromatic pattern even if a filter of the chromatic color is used.

Another such pattern that cannot be recognized by the prior art method is a pattern composed of two colors of similar brightnesses. An example is a blue foreground pattern with a red background pattern both having similar brightnesses. In this case, one of the patterns, say the red pattern, cannot be accurately discriminated from the other (blue). Placing a red filter in the optical path between the cloth and the sensor to selectively pass the red light would be one solution. But once a color filter is fixed to the red color, the pattern sensor could not cope with other patterns having various colors: that is, the variety of cloth patterns that could be matched would be limited.

When, on the contrary, a pattern structure is quite simple and includes colors having large brightness difference, the minimum processing speed is preferred by simplifying the data processing. Especially when the electronic control unit must spend much time for executing other operations, such as for sewing mechanism control, the pattern-matching processing is required to be finished effectively in a limited time.

SUMMARY OF THE INVENTION

An object of this invention is therefore to provide a pattern-matching sewing machine that can match the patterns of sheets having various types or characteristics of patterns.

A sewing machine, as shown in FIG. 1, according to the present invention for sewing two sheets having the same pattern, matching the patterns on the respective sheets comprises: first and second feeding means M1, each for intermittently feeding one of the sheets; first and second photo-sensing means M2, each for optically sensing the pattern on one of the sheets during feeding and for generating photo-intensity data; a plurality of mismatch detecting means M3, each for calculating a mismatch distance of the patterns on the two sheets using an algorithm different from that of another mismatch detecting means M3; a mode selecting means M4 for selecting one of the plurality of mismatch detecting means M3 according to characteristics of the pattern of the two sheets; and a feed-adjusting means M5, based on the mismatch distance calculated by the selected mismatch detecting means M3, for adjusting one of the feeding means M1 to match the patterns.

The first and second photo-sensing means M2 receive light from the corresponding sheets and generate the photointensity signals. For example, they may include three independent sensors sensitive to the three primary colors, R (red), G (green) and B (blue). Alternatively, each of them may comprise a single sensor and several color filters that are rapidly interchanged at high speed to sense two or more colors in a time divisional manner. The first and second photo-sensing means M2 may each have a light source that projects light to the corresponding sheet. In this case, the photo-sensing means M2 can be realized by providing a plurality of light emitting diodes which emit the particular colors, or by providing color filters corresponding to the colors between the light source and a photo-sensor.

Examples of the mismatch detecting means M3 are as follows. One of them calculates differences between the intensities of different colors detected by the first and second photo-sensing means M2. For example, when the first and second photo-sensing means M2 detect the three primary colors, R (red), G (green) and B (blue), differences (R−G), (G−B) and (B−R) are calculated. It may further add the absolute values of these differences together to emphasize the differences. Another mismatch detecting means M3 may have a process in which the calculation is not executed until predetermined number of data are collected. Still another such means M3 may have a process in which the calculation is executed in parallel with the collecting of the intensity data to shorten the calculation intervals. Still another such means M3 may have a process to calculate the mismatch distance based on the rise-up position of the brightness signal when the duration of the brightness signal is within a predetermined range, on the assumption that the signal is caused by the pattern. The mismatch detecting means M3 may have a pattern limitation function by which the calculation is performed only with patterns of specific structure or colors designated by the operator in advance. Two or more mismatch detecting means M3 with different algorithms may be selected at one time in order to conduct cross-checking among them.

The mode selecting means M4 may be a selecting switch operated by the operator. Alternatively, it may be constructed to automatically select one of the mismatch detecting means M3 on the assumption that the smallest value of the mismatch distance is most accurate.

The mode selecting means M4 may also have the construction as follows. Many patterns are previously stored, each correlated to one of the mismatch detecting means M3, and if the pattern to be sewn is identical to a stored pattern, the correlated mismatch detecting means M3 having an algorithm most suitable to the pattern is automatically selected. In this case, the pattern identification can be made by comparing data changing patterns between the stored pattern and the cloth pattern. If the pattern to be sewn is not identical to any of the stored patterns, a predetermined mismatch detecting means M3 may be selected, or the cloths may be sewn without pattern matching.

After the sheets are adjusted to match the pattern, they are sewn by the sewing means M6.

BRIEF EXPLANATION OF THE ATTACHED DRAWINGS

FIG. 1 is a block diagrams, illustrating a typical structure of a pattern-matching sewing machine using this invention.

FIG. 2 schematically illustrates the mechanical structure of a sewing machine embodying this invention.

FIGS. 11A through 11D are graphs showing patterns on the upper and lower cloths and the data resulted from the smooth processing.

DETAILED DESCRIPTION OF PREFERRED EMBODIMENT

Figure 1:
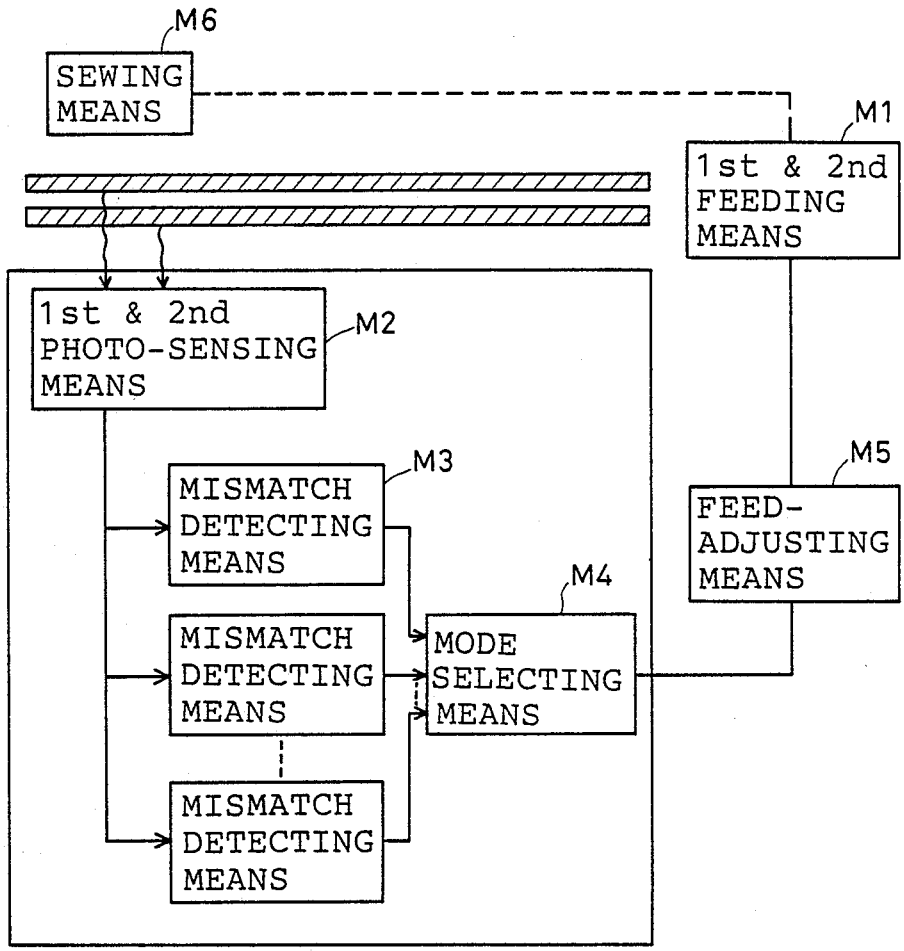
Figure 2:
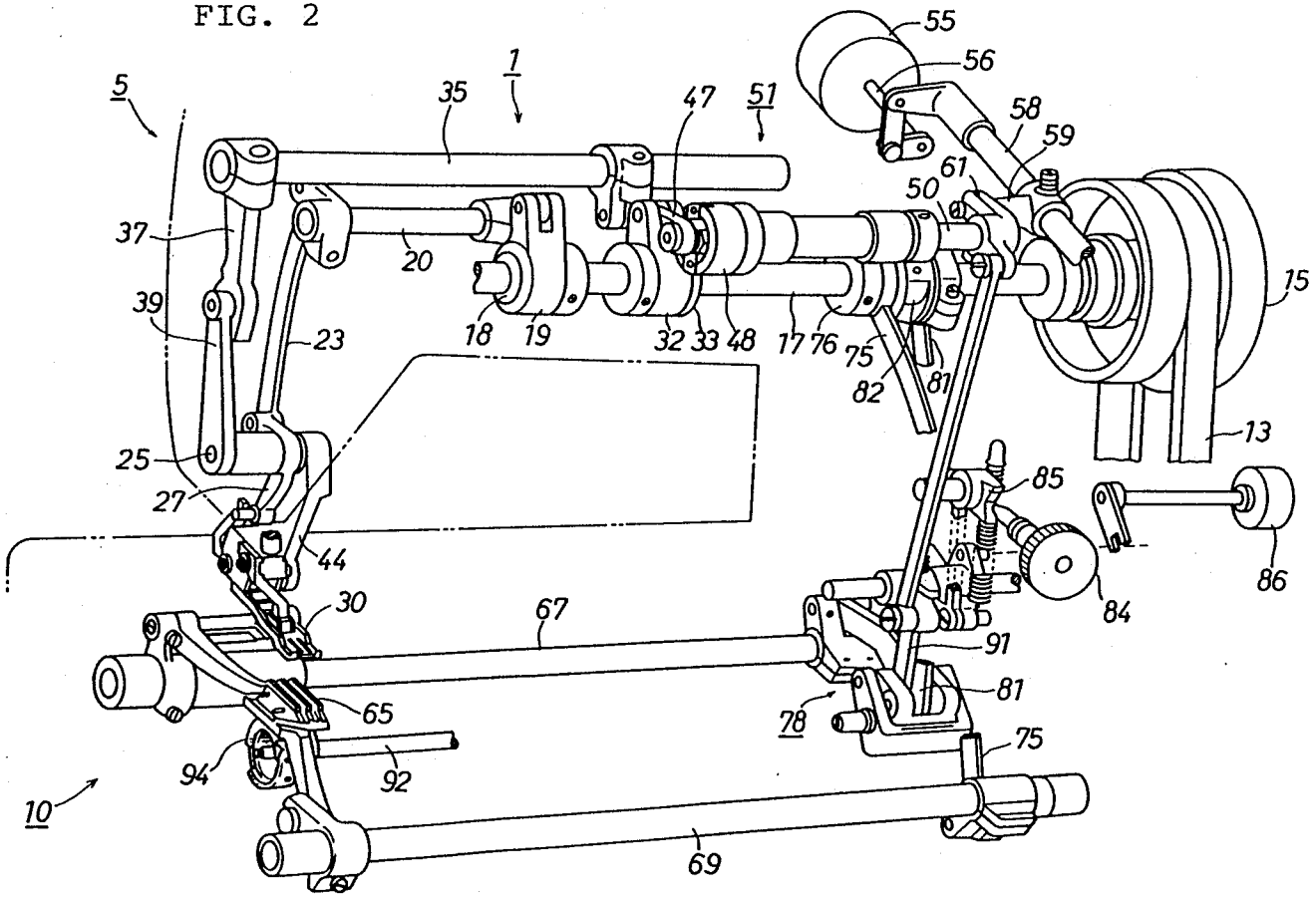

FIG. 2 illustrates a sewing machine as an embodiment of the pattern-matching sewing machine. This sewing machine is controlled by a microcomputer to sew two cloths having the same pattern so their patterns match. The mechanical structure of the sewing machine is explained first.

The sewing machine 1 includes an arm part 5 and a bed part 10. The arm part 5 includes a main shaft 17 that is driven by a main motor 190 (FIG. 4) via a belt 13 and a pulley 15. The main shaft 17 has an eccentric cam 18 that connects to a working shaft 20 via a crank rod 19. Thus the working shaft 20 rotates through a predetermined angle with the rotation of the main shaft 17 and gives a connection link 23 a vertical motion. The connection link 23 connects to an arm 27 that swings about a support shaft 25. The swinging motion of the arm 27 gives an upper feed dog 30 vertical motion.

The main shaft 17 connects, via a crank rod 32, another eccentric cam 33, and a link 47, to a working shaft 35. The working shaft 35 swings through a predetermined angle according to the rotation of the shaft 17 to impart a stroke motion to levers 37 and 39. The lever 39 is articulated with an arm which swings about the shaft 25. The swinging motion of the arm 44 imparts a stroke drive to the upper feed dog 30. Thus the upper feed dog 30 makes a four-motion feed: up, forward, down, and backward.

The stroke motion amount of the upper feed dog 30, i.e., the feed amount of the upper cloth, is determined by the swinging motion amount of the shaft 35. The link 47 connects to an upper feed adjuster 48 on one end of a rotary shaft 50. The adjuster 48 changes the swinging motion amount of the shaft 35 by changing the inclination of the link 47. The crank rod 32, eccentric cam 33, link 47, upper feed adjuster 48 and rotary shaft 50 form an upper feed adjusting mechanism 51.

At the other end of the shaft 50 is a rotary lever 61 with two oppositely extending arms. One arm abuts on a stopper 59 attached to a drive shaft 58 that is connected to an output shaft 56 of a step motor 55. Accordingly the step motor 55 moves the stopper 59, the stopper 59 regulates the lever 61, and the lever 61 limits the rotative angle of the shaft 50 and the swing amount of the shaft 35, which determines the upper feed amount.

The bed part 10 includes a horizontal feed shaft 67 and a vertical feed shaft 69 for making a lower feed dog 65 into a four-motion feed similar to the upper feed dog 30. The vertical feed shaft 69 is connected, via a crank rod 75 and an eccentric cam 76, to the main shaft 17, and rotates through a predetermined angle with the rotation of the shaft 17 to give the lower feed dog 65 a vertical motion. The horizontal feed shaft 67 is connected, via a lower feed adjuster 78, a crank rod 81, and the eccentric cam 82, to the main shaft 17, and rotates through a predetermined angle with the rotation of the main shaft 17 to give the lower feed dog 65 a horizontal motion. The lower feed adjuster 78 converts the longitudinal motion of the crank rod 81, which is driven by the rotation of the main shaft 17, to the swinging motion of the horizontal feed shaft 67, and changes the swing distance.

A manual feed control knob 84 is provided outside of the frame of the sewing machine to adjust the inclination of a feed set notch 85 on which the end of the knob 84 abuts. The notch 85 is connected to the adjuster 78 via a link 91. When its inclination is changed, the feed amount is changed by the lower feed adjuster 78. The lower feed amount thus can be changed by the manual feed control knob 84. The notch 85 further connects to a potentiometer 86 that generates a signal corresponding to the lower feed amount.

Figure 3:
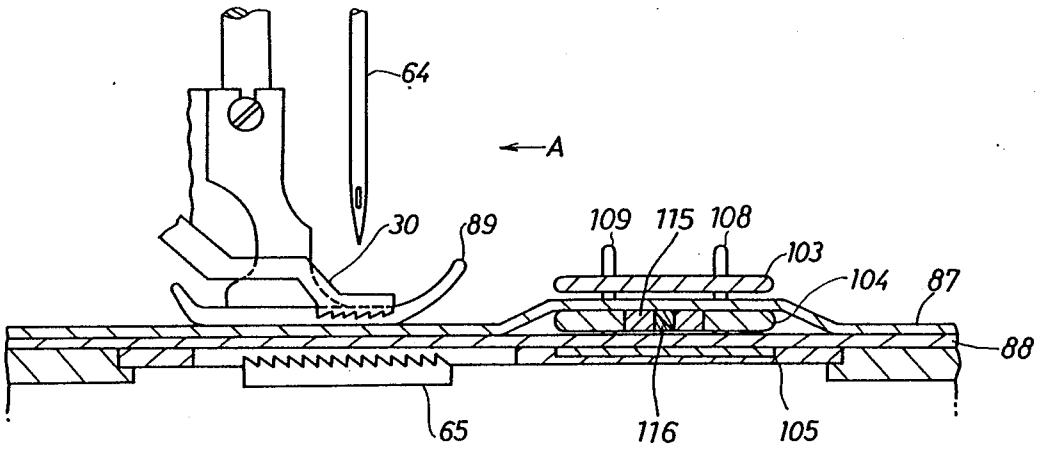
FIG. 3 illustrates the stitching section of the sewing machine.

A needle 64 (FIG. 3) is attached to a needle bar (not shown), which moves vertically synchronously with the main shaft 17. Within the bed part 10 below the needle 64 is a loop taker 94 attached to a lower shaft 92, which also rotates synchronously with the main shaft 17. Accordingly, at the sewing part (FIG. 3), synchronously with the rotation of the main shaft 17, the needle 64 and the loop taker 94 cooperate to sew together two cloths 87, 88 set under a presser foot 89, and the upper and the lower feed dogs 30 and 65 feed them in direction A (FIGS. 3 and 4) with the four-motion feed.

Upstream of the sewing part, three guide plates 103, 104, and 105 are placed in parallel to the machine bed, in which the lower guide plate 105 is embedded. Two pins 108 and 109 (FIGS. 3 and 4) stand upward on the lower guide plate 105 to penetrate long holes formed in the middle and upper plates 104 and 103, and guide the side edges of the cloths 87 and 88.

Figure 5A:
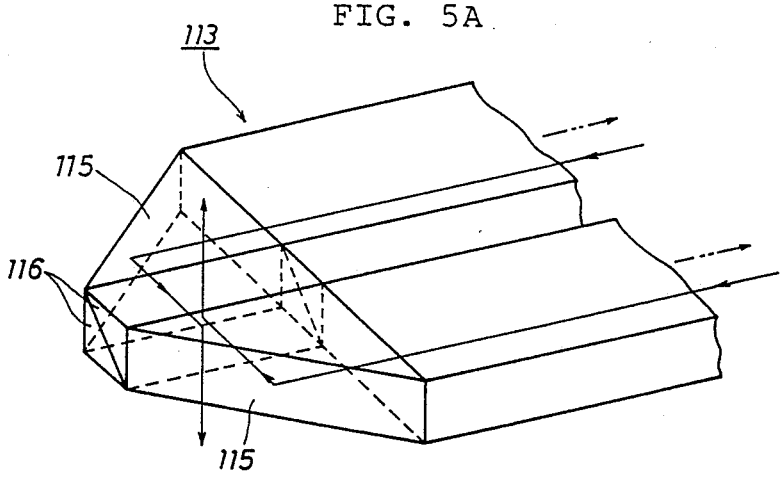
FIGS. 5A and 5B illustrate an end of the pattern detector and an internal structure of its light conduit.
Figure 5B:
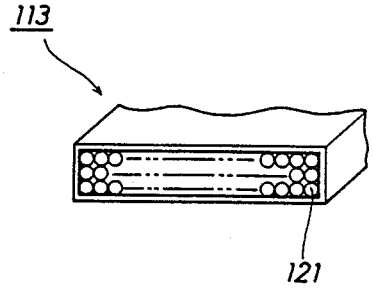

A detector 113 for detecting patterns on the two cloths 87 and 88 is embedded in the middle guide plate 104. As shown in FIG. 5A, prisms 115 and 116 are attached at the tip of the detector 113. Light from a conduit is reflected by the prisms 115 and 116 to the cloths 87 and 88, and the light reflected by the surfaces of the cloths 87 and 88 retraces the incident path. As shown in FIG. 5B, the conduit in the detector 113 includes a bundle of optical fibers 121 that connects to a control box 124 of the sewing machine.

Figure 4:
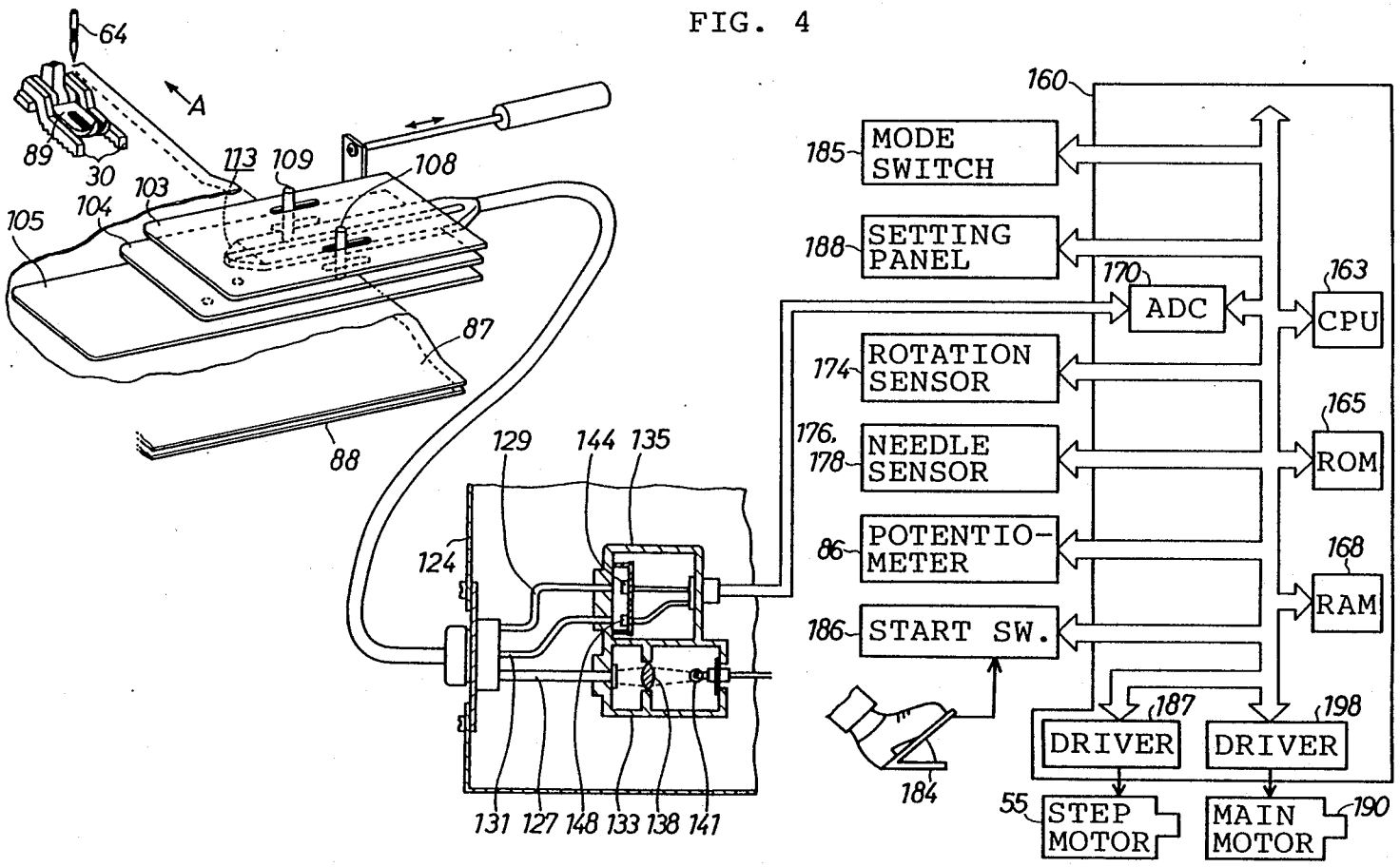
FIG. 4 illustrates the structure of a pattern detector and its control.

As shown in FIG. 4, the optical fibers 121 includes fibers 127, as shown in FIG. 4 for projecting the light and fibers 129 and 131 for receiving the light. The projecting fibers 127 communicate with a light source unit 133, and the receiving fibers 129 and 131 with photo-sensors 144 and 148, in the control box 124. In the light source unit 133, a lamp 141 projects white light into the fibers 127 through a lens 138. The fibers 129 and the photo-sensor 144 correspond to the upper cloth 87, and the fibers 131 and the photo-sensor 148 correspond to the lower cloth 88.

Figure 6:
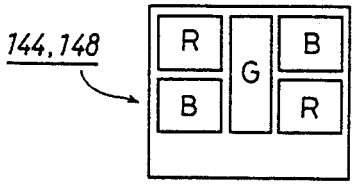
FIG. 6 illustrates an arrangement for color filters in a photo-sensor.

As shown in FIG. 6, the photo-sensors 144 and 148 have red (R), green (G) and blue (B) color filters, and a photo diode corresponding to each color filter. Plural color filters of the same color are arranged apart so as to obtain a broader scope for receiving stray light. That is, even if the light from the fibers 129 and 131 is to the sensors 144 and 148 is skewed, it can be detected by any one of the matching color filters. Thus, the white color from the light source 141 is sent to cloths 87 and 88 when reflected by prisms 115 and 116 in the detector 113 using fibers 127.

The light reflected by the cloths 87 and 88 is decomposed into the three primary colors (R, G and B) by the color filters, and the intensity data for respective colors are generated in the photo-sensors 144 and 148. The color intensity data are sent to an electronic control unit 160 built within the control box 124.

As shown in FIG. 4, the electronic control unit 160 is a microcomputer including a CPU (central processing unit) 163, ROM (read only memory) 165, RAM (random access memory) 168, ADC (analog-to-digital converter) 170, and driver circuits 187 and 198. The ADC 170 connects to the color sensors 144 and 148, the drive circuit 187 to the upper-feed adjusting step motor 55, and the drive circuit 198 to the main motor 190 of the sewing machine. The electronic control unit 160 also connects to: a rotation sensor 174 in the pulley 15 for generating twenty-four (24) pulse signals per rotation of the main shaft 17; needle position sensors 176 and 178 also in the pulley 15 for generating, respectively, low-position and high-position signals for the needle position; the potentiometer 86 for detecting the lower feed amount; a start switch 186 at a pedal 184 for generating start and stop signals for sewing; a mode switch 185 for selecting one of three different calculation modes; a setting panel 188 for setting the pattern-setting parameters according to patterns on the cloths 87 and 88; and the mode 1, 2, 3 respectively correspond to different algorithms for calculating the mismatch distance, which will be explained later based on flowcharts.

Figure 7:
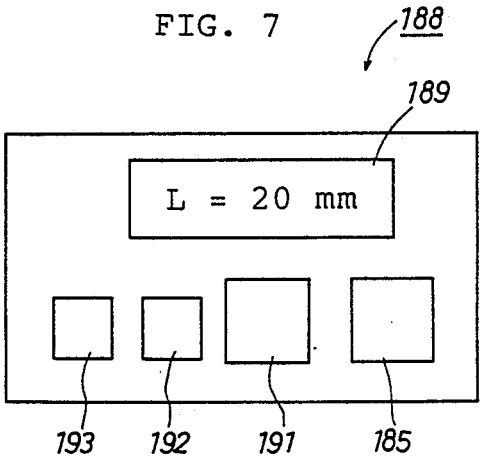
FIG. 7 illustrates a setting panel.

As shown in FIG. 7, the setting panel 188 includes a liquid crystal display 189, a changing key 191 for initiating a change of the preset length for the control of mismatch distance calculation, and an increment key 192 and a decrement key 193 for increasing and decreasing the length when the changing key 191 is operated. The mode switch 185 is placed on the setting panel along with those keys. A control routine for pattern matching is stored in the ROM. In the RAM 168, memory regions of a predetermined number Cm are allocated where the color data sampled by the photosensors 144 and 148 are successively stored.

The pattern matching control routine of the sewing machine is now described. FIGS. 8A through 8E are flowcharts for a pattern matching control routine, and FIG. 9 is a flowchart of an interrupt processing routine. A value of the preset length was set on the setting panel 188 before the power was turned off is preserved by a backed-up memory, and, when the power of the sewing machine is turned on, the stored value becomes the initial value. When the sewing machine is used for the first time, or if it has not been used for a long time, the preset length L is set at 20 mm, and the predetermined reference number Cm is determined based on the length L and the lower feed amount output from the potentiometer 86. When cloths different from those handled before are to be sewn, the operator turns on the changing key 191, and pushes the increment or decrement key 192 or 193 to set a new length L corresponding to the new pattern. Normally the length L is set slightly longer than the recurring distance of the pattern, and L should be longer than the longest solid (or unpatterned) segment of the pattern to detect any intensity change. A mode value set by the mode switch 185 is also preserved in the back-up memory in the same manner as the value of Cm. The mode value can be cyclically changed by pressing the mode switch 185.

Figure 9:
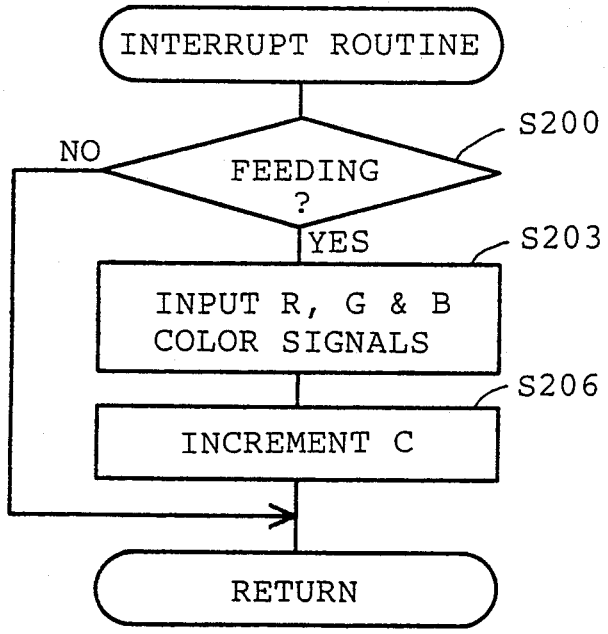
FIG. 9 is a flowchart of an interrupt processing routine.
Figure 10:
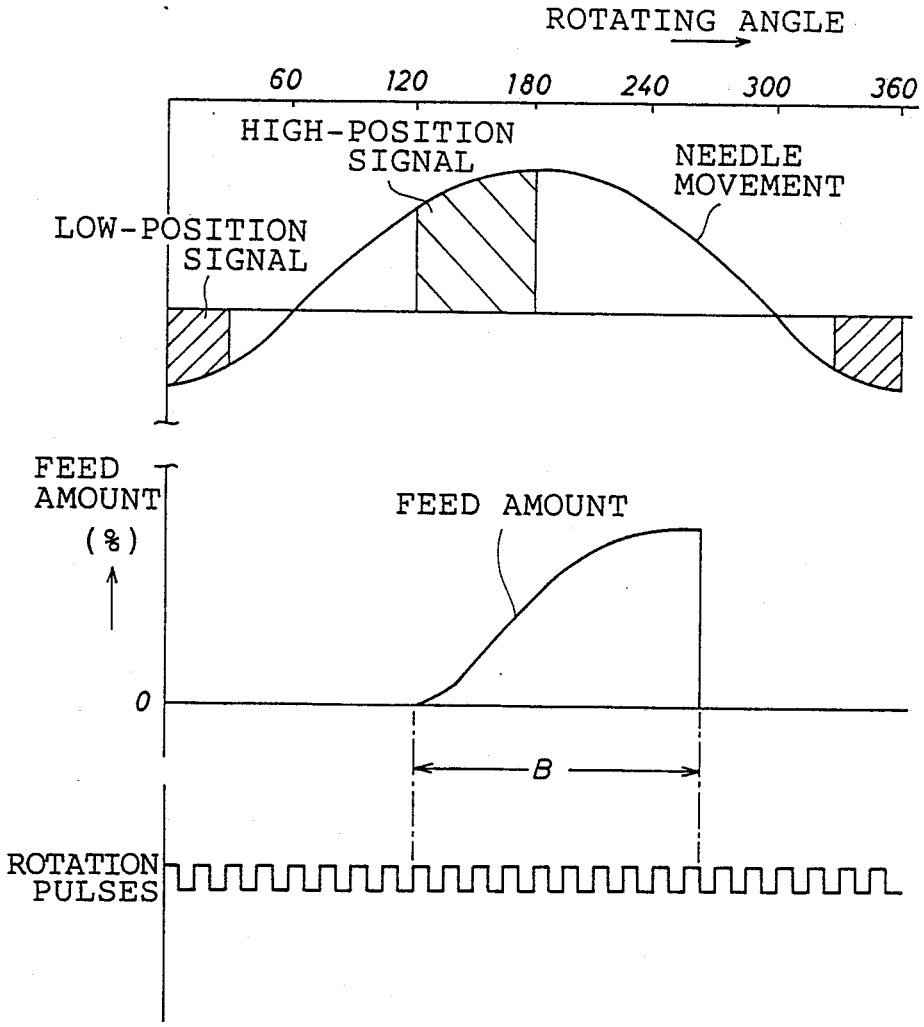
FIG. 10 is a graph illustrating needle position, feed amount and pulse signals generated by a rotation sensor.

First, the interrupt processing routine (FIG. 9) is explained. This routine is started at every falling edge of the rotation pulse signal from the rotation sensor 174. As shown in FIG. 10, the rotation sensor 174 generates twenty-four (24) pulse signals during a rotation of the main shaft 17, so that each time the main shaft 17 rotates through fifteen (15) degrees, the routine is executed.

In the interrupt processing routine, it is first examined, at step S200, whether the pulse signal from the rotation sensor 174 is within a cloth feeding movement (B in FIG. 10). If not, the routine ends. If the pulse signal from the rotation sensor 174 is within the feeding movement, six color intensity data (red, green and blue intensity data from the upper cloth 87 and the lower cloth 88) sensed by the photo-sensors 144 and 148 are converted to digital signal by the ADC 170 and are stored as one set of color data in the RAM 168 (step S203). A counter C for the color data set is incremented by one at step S206, and this routine ends.

Figure 8A:
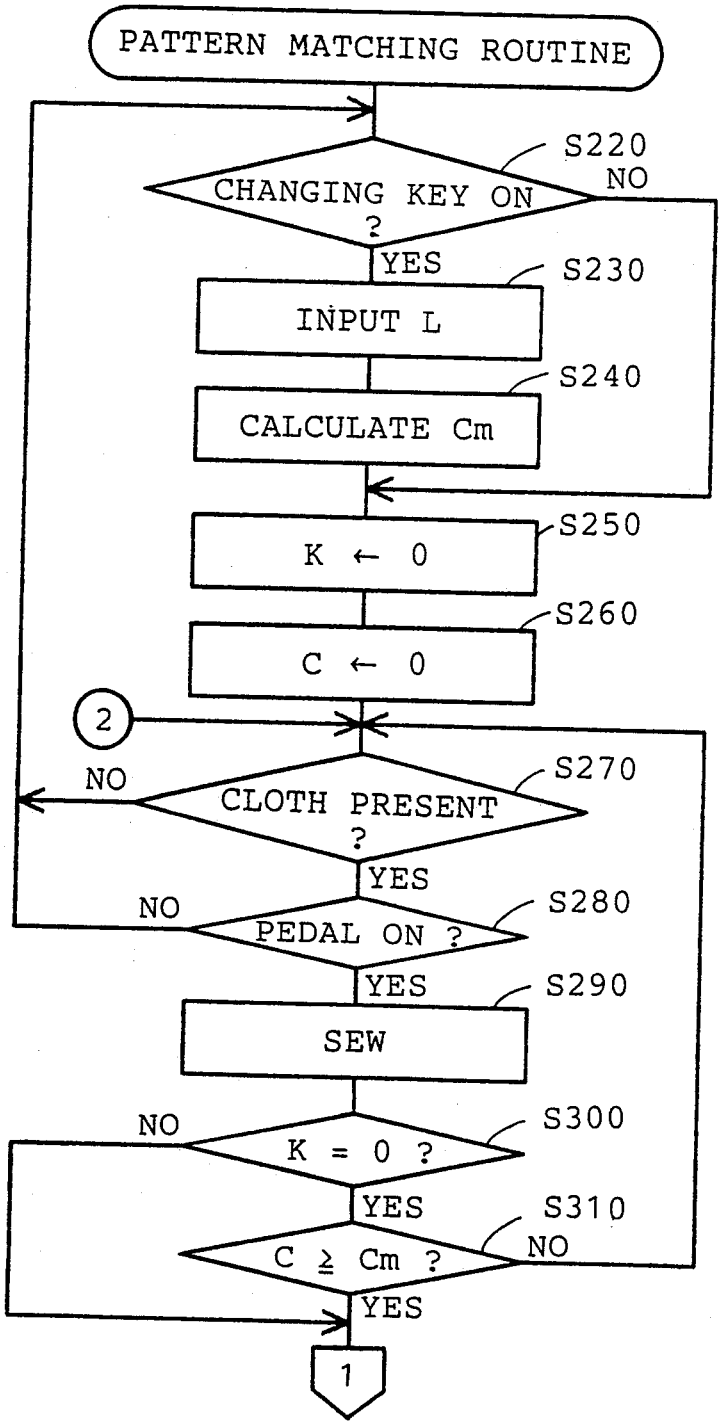
FIGS. 8A through 8E are flowcharts of a pattern matching control routine.

The pattern matching control routine is now explained with FIG. 8A. This routine is executed at preset time intervals. First the state of the changing key 191 is examined at step S220. When the key 191 is not turned on, the length L is not changed and the process goes to step S250. When the key 191 is turned on, the length L set by the operator is input at step S230, and the reference number Cm is calculated at step S240. The number Cm represents the number of color data sets corresponding to the length L, and is calculated as follows:

$$Cm = Np \cdot L / Df,$$

where Np is the number of pulses in the feeding range and Df is the feed amount. For example, when the length L is set at 30 mm and the feed amount is 1 mm, Cm is calculated as 10 (pulses)×30 (mm)/1 (mm)=300, since the number of pulse signals is 10 (pulses) per main shaft rotation in the feeding stage.

Subsequently, a control counter K and the counter C for the color data sets stored in the RAM 168 are cleared at zero at steps S250 and S260. Then, the CPU 163 waits until the upper and lower cloths 87 and 88 are set and the pedal 84 is pressed at steps S270 and S280 respectively, at which time the CPU 163 drives the machine main motor 190 to start sewing at step S290.

While the main motor 190 rotates during sewing, the interrupt processing routine (FIG. 9) is repeatedly executed and the color data sets are sequentially stored in the predetermined memory region of the RAM 168. When the control counter K is 0 and the number of color data sets C is less than the reference number Cm, the program waits here. When the number C reaches Cm, the next pattern matching processing is executed at steps S300 and S310 respectively.

Figure 8B:
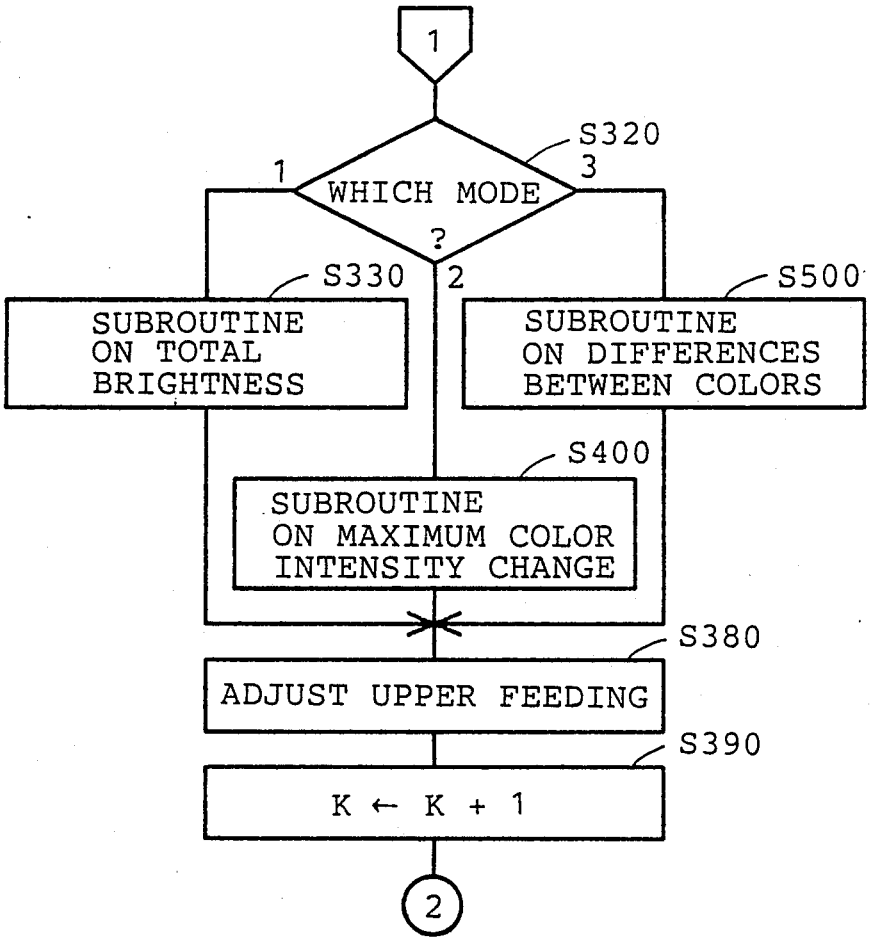

Referring then to FIG. 8B, the state of the mode selection switch 185 selected to either 1, 2, or 3 by the operator is read at step S320. Then a mismatch distance is calculated in accordance with the selected mode at steps S330, S400, or S500. Hereinafter, each calculation mode (mismatch detecting means) will be described.

Figure 8C:
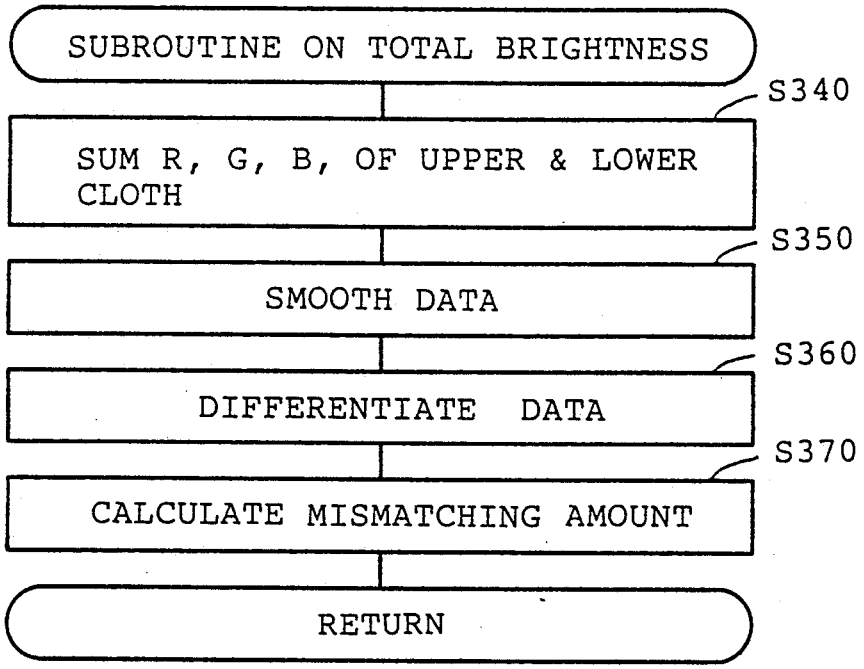

First, when the mode 1 is selected, a subroutine for calculating mismatch distance on total brightness is executed (S330) as shown in FIG. 8C. This routine will be explained using the pattern made by a brightness change of only one color as shown in FIGS. 11A and 11B.

The newest color data sets of the number Cm stored in the RAM 168 are read, and the data of R, G and B colors sampled by the sensor 144 are summed to make a total brightness data of the upper cloth 87 at step S340. The data of R, G, and B colors sampled by the other sensor 148 are also summed to make a total brightness data of the lower cloth 88 at step S340.

A smoothing ("averaging" in the claim terminology) operation for the total brightness data then performed, i.e., data of 21 points from before and after a point is added to the data of that point, and the sum is divided by 43 (=21+1+21) to obtain the smoothed data for that point at step S350. The smooth processing removes influences of noise from the sampled color data. The results are shown in FIGS. 11C and 11D.

Figure 12A:
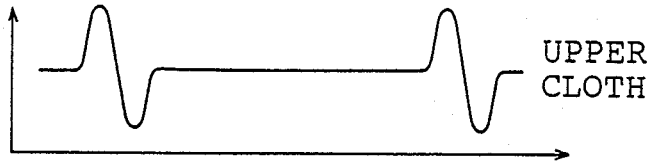
FIGS. 12A and 12B are graphs respectively showing the differentiated data of the upper and lower cloths.
Figure 12B:
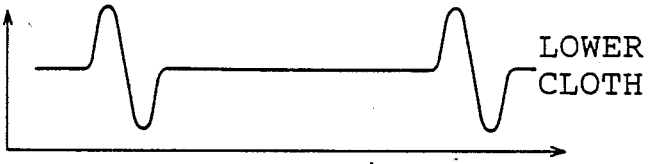

The smoothed data is then differentiated at step S360 so as to further emphasize the acute change in the data and to further moderate the gentle change in the data. As the results, as shown in FIGS. 12A and 12B, the gentle peaks due to the longitudinal (with respect to the feeding direction) stripes are eliminated.

Figure 13:
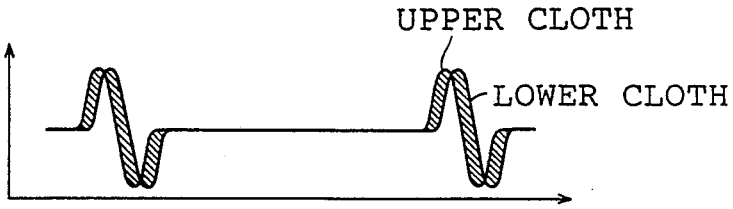
FIG. 13 is a graph showing the superposition of the differentiated-data peaks for the upper and lower cloths.

The differentiated data of either the upper and the lower cloth is amplified as necessary so that their peak-to-peak heights of the cloth 87 and the cloth 88 Vp-p becomes equal. An offset processing is then performed where an average value of all points is subtracted from each point so that the mean value becomes 0. The resultant curves of the upper cloth 87 and lower cloth 88 are overlapped as shown in FIG. 13. The curves are relatively shifted to minimize the difference area (shaded in FIG. 13), by which the direction and the amount of the pattern mismatch is calculated at step S370. After the calculation, the program returns to the main routine of FIG. 8B to drive the step motor 55 and adjusts the upper feed amount according to the calculated mismatch distance at step S380. The value of the control counter K is increased by 1 at step S390. The program returns to the step S270 of FIG. 8A and repeats the same processing.

Figure 14B:
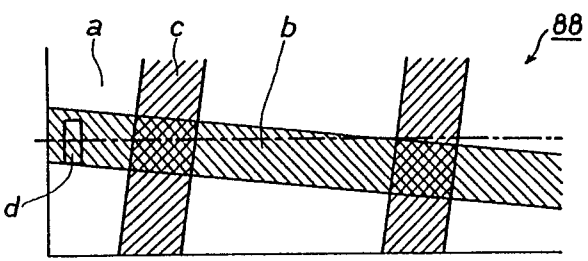
FIGS. 14A through 14D are graphs respectively showing patterns on the upper and lower cloths and their color data.

The routine to be executed when the mode 2 is selected at step S320 will be described. When the mode 2 is selected, a subroutine for calculating the mismatch distance on the color data of the greatest intensity change is executed at step S400. This subroutine will be explained using the upper and the lower cloth 87 and 88 of FIGS. 14A and 14B having the same pattern. The patterns of cloths 87 and 88 is composed of a gray background (gray cloth) a with a check of a blue longitudinal (with respect to the feeding direction) b and blue transverse c lines. The both blue colors of the check pattern have equal brightness to the gray cloth color. Therefore, special treatment is necessary to distinguish the blue check pattern from the background color in the pattern matching. Further, it is naturally understood that the pattern matching is better performed for the transverse lines c than for the longitudinal lines b. Reference letter d, small region in FIGS. 14A and 14B designates the area of photo-detection.

Figure 8D:
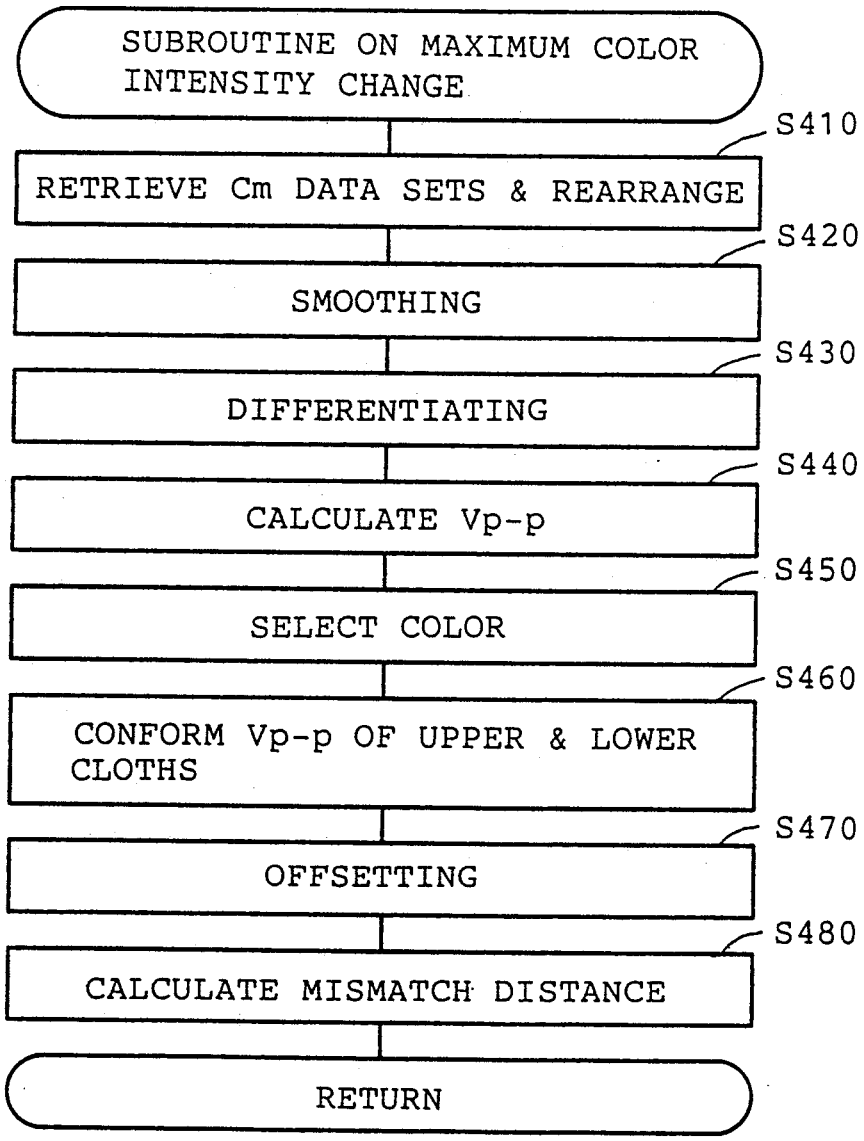
Figure 8E:
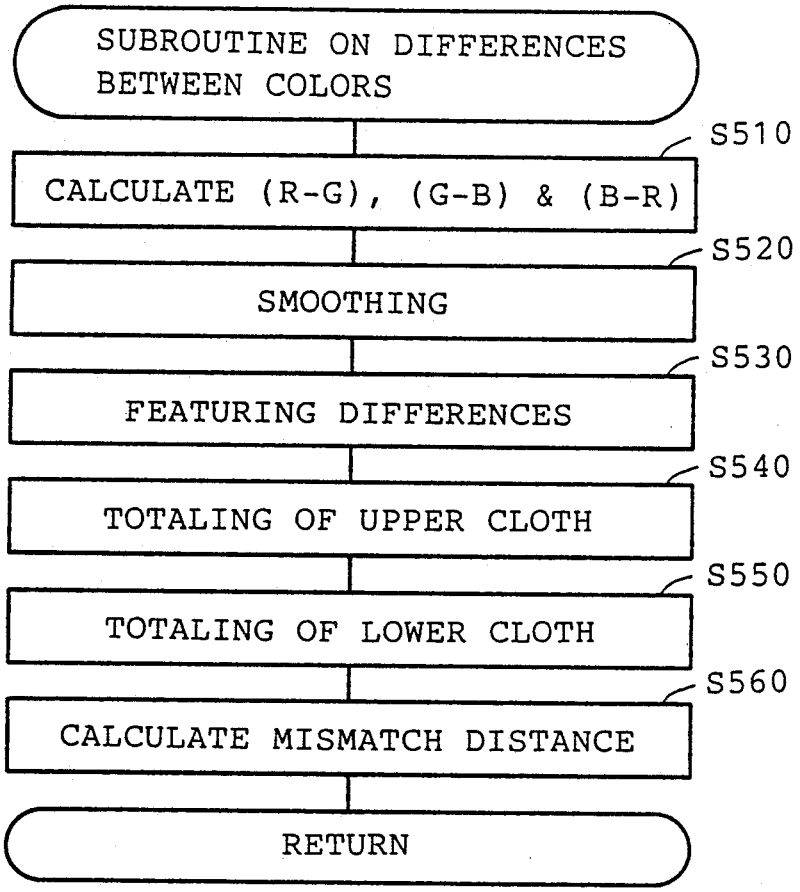
Figure 14D:
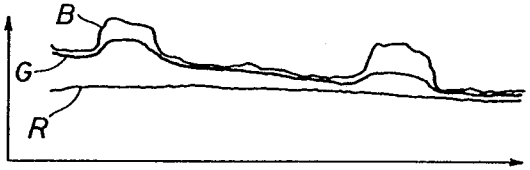
Figure 14A:
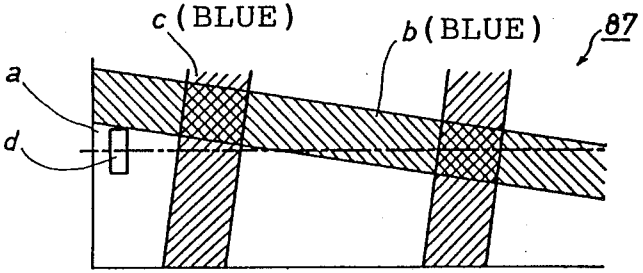
Figure 14C:
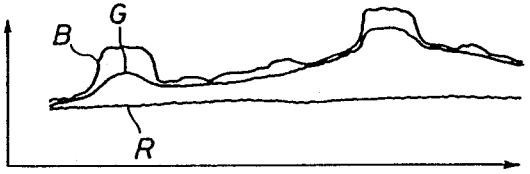
Figure 15A:
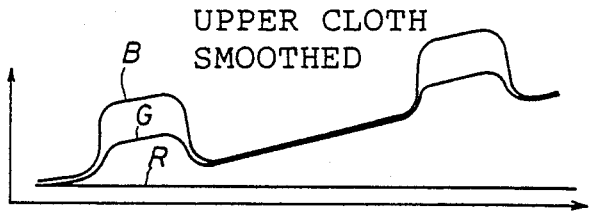
FIGS. 15A and 15B are graphs showing the smoothed data.
Figure 15B:
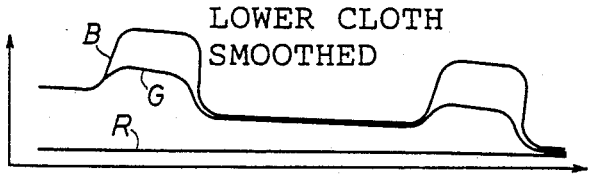

After Cm sets of the color data are collected by the photo-sensor system at step S310 (FIG. 8A), the latest Cm color data sets are retrieved from the RAM 168 at step S410 and the subsequent data processing, as shown in FIG. 8D, are made on those data sets. The retrieved data are rearranged into six data sequences, each respectively corresponds to: red R, green G and blue B intensity data sequences for the upper cloth 87, and red R, green G and blue B for the lower cloth 88. The data sequences are shown in FIGS. 14C and 14D. In this subroutine, summing of three color data is not performed, instead the smoothing operation is performed for every color at step S420. That is, intensity data of 21 points from before and after a point of one color is added to the intensity data of that point, and the sum is divided by 43 (=21+1+21) to obtain the smoothed data of that point. FIGS. 15A and 15B show the smoothed data.

Figure 16A:
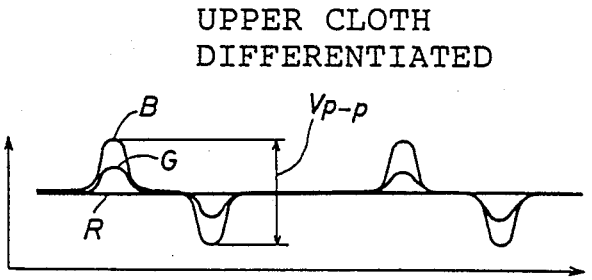
FIGS. 16A and 16B are graphs showing the differentiated data.
Figure 16B:
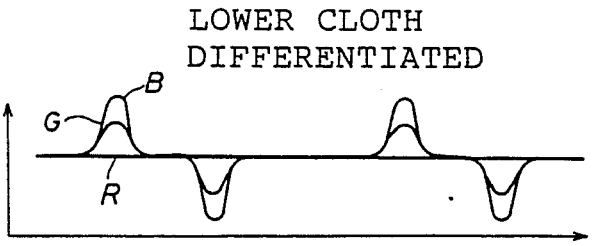

The smoothed data is then differentiated at step S430. The results are shown in FIGS. 16A and 16B which show that the differentiating operation emphasizes the acute changes and moderates gentle changes in the smoothed data. Therefore, a gentle change caused by the longitudinal line b is removed in the differentiated data.

At subsequent step S440, a peak height Vp-p between the maximum and minimum peak values of the differentiated data for each color of the upper and lower cloths 87 and 88 is calculated.

The peak heights Vp-p of the upper and the lower cloths 87 and 88 are added for each of the three colors R, G and B, and the color with the greatest sum is selected at step S450. In FIGS. 16A and 16B, the blue (B) color has the greatest sum, i.e., has the greatest intensity change, so the blue color is selected.

The differentiated data (of the selected blue color) of either the upper and lower cloths is amplified as necessary so that their peak heights Vp-p becomes equal at step S460. Then, an offset processing is performed at step S470: an average value of all points is subtracted from each point so that the average value of the blue differentiated data becomes 0.

Figure 17:
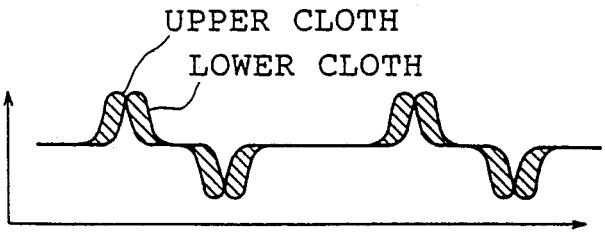
FIG. 17 is a graph illustrating the superposition of differentiated-data peaks for the upper and lower cloths.

Then the mismatch distance is calculated based on the offset-processed data at step S480. Specifically, the offset-processed differentiated data of the upper and lower cloths 87 and 88 are superposed as shown in FIG. 17, and the difference area of the two curves (shaded in FIG. 17) is measured. The differentiated data are shifted in the data feed direction, and when the difference area becomes minimum, that shifted distance is the mismatch distance.

The step motor 55 is driven according to the calculated mismatch distance to adjust the upper-feed amount at step S380 (FIG. 8B). When the adjustment of the upper-feed amount is completed, the control counter K is incremented by one at step S390 and the present routine ends. Then, the program returns to step S270.

The routine executed in case of the mode 3 will be described. The subroutine at step S500 calculates the mismatch distance based on differences between colors.

Figure 18A:
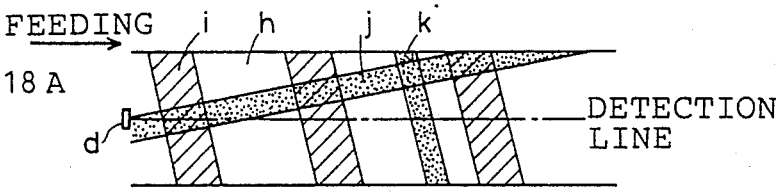
FIGS. 18A through 18G are graphs illustrating an example pattern and processing results for its color data.
Figure 18B:
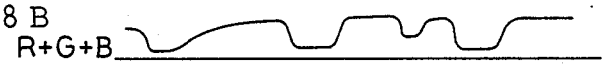
Figure 18C:
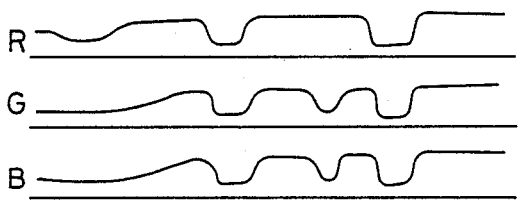

In this pattern matching processing also, calculations are performed based on the latest Cm number of color data sets. As shown in FIG. 18A, the cloths 87 and 88 have the same pattern: a check of thick j and thin k red-lines over stripes of white h and black i. The thick red-line j lies almost longitudinal to the direction the cloths move and the thin red line k lies almost transverse to that movement. The small region d is the photo-detection area. The intensity of the total brightness of the pattern is shown in FIG. 18B, and the intensities of the three colors (R, G and B) are separately shown in FIG. 18C.

Figure 18D:
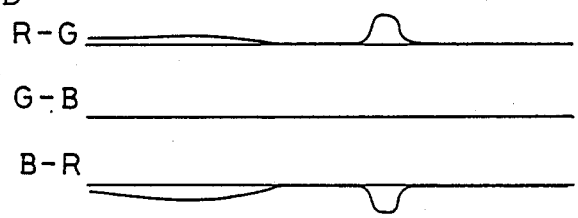

First, Cm color data sets are read from the RAM 168, and differences between the three primary colors (R−G), (B−R) and (G−B) are calculated at step S510. The differences are shown in FIG. 18D. By these difference calculations, color components having equal intensities in the three primary colors are removed. Since achromatic color, such as the white h and the black i of the cloth pattern, develops intensities equal to the three primary colors R, G and B, such black and white stripes do not affect the difference data.

Figure 18E:
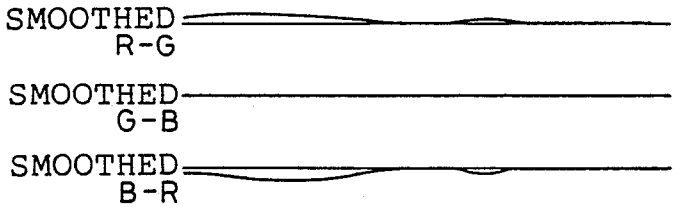

Then a smoothing ("averaging") operation is performed for each point of the difference data at step S520. The smoothing operation for a point is done by adding data of 125 points from before and after that point to the data of that point, and dividing the sum by 251 (=125+1+125) to obtain a smoothed data of that point. The result is shown in FIG. 18E. This smoothing operation flatterns the acute peaks due to the transverse red lines k but the gentle curves due to the longitudinal red lines j remain almost unchanged.

Figure 18F:
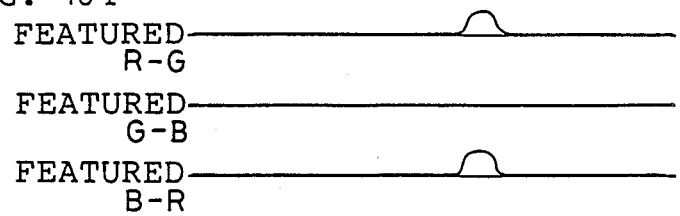
Figure 18G:
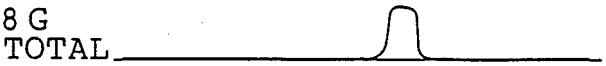

Then featuring differences between the smoothed curves and the unsmoothed original curves are calculated at step S530. This featuring difference operation eliminates the gentle curves due to the longitudinal red lines j but the acute peaks due to the transverse red lines k remain. Absolute values of the featuring difference curves are shown in FIG. 18F. Further, absolute values of the featuring difference data of the three primary colors are added together at steps S540 and S550 to get emphasized-difference data in which the acute peaks of the transverse red lines k are emphasized. This result is shown in FIG. 18G.

Using this emphasized-difference data calculated from the color data from the upper and lower cloths 87 and 88, the mismatch distance between the two cloths 87 and 88 is calculated at step S560, and the step motor 55 is driven to adjust the feed of the upper cloth 87 to match the patterns.

The program returns to the main routine where the upper feed amount is adjusted by driving the step motor 55 in the same manner as the modes 1 and 2 at step S380. After adjusting the upper feed amount, the control counter K is increased by 1 at step S390. Then, the processing from step S270 is repeated again.

As mentioned above, the machine for pattern match sewing of this embodiment allows its operator to choose an appropriate mode for calculating the mismatch distance depending on characteristics of the patterns the cloths bear. If the cloth bears a pattern having monochrome colors with different brightness, the operator can select the mode 1 for calculating the mismatch distance fast. In case of a pattern having different colors and similar brightnesses, the operator can select the mode 2. In case of a pattern having achromatic colors with high and low brightnesses on a chromatic color with low brightness, the operator can select the mode 3 for the calculation.

Therefore this machine is able to conduct exact pattern match sewing for various kinds of patterns.

Figure 19:
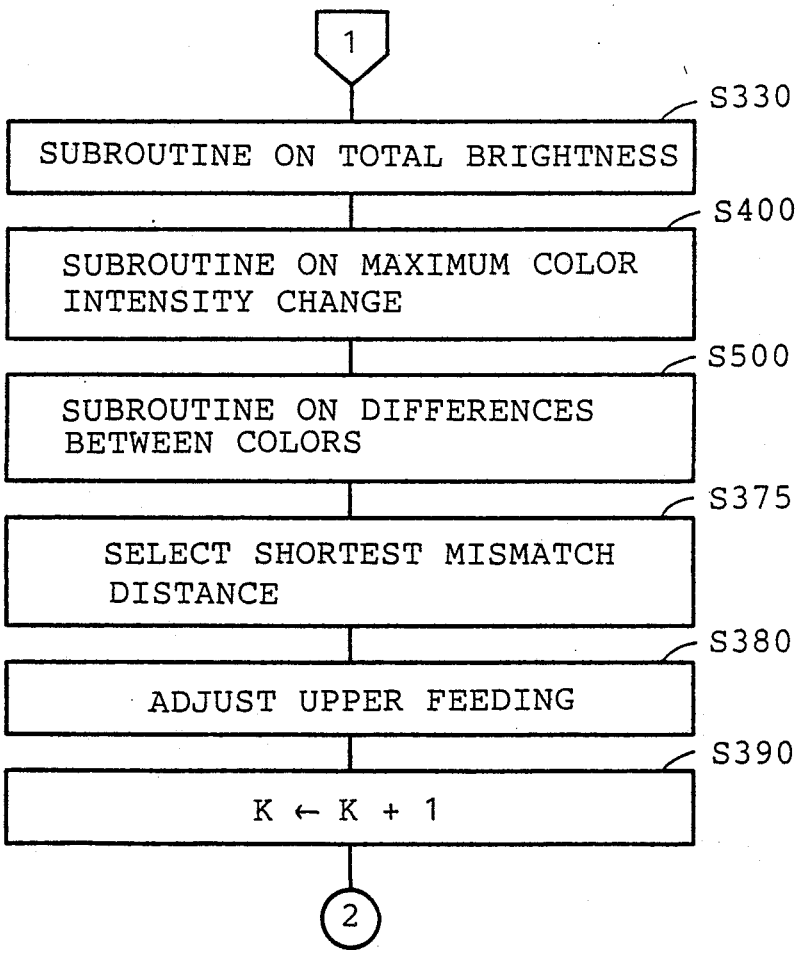
FIG. 19 is a substitute flowchart of the flowchart of FIG. 8B that automatically select a calculation mode.

The selection of the modes may be made automatically, as shown in FIG. 19. After calculating the mismatch distances according to the modes 1, 2, and 3 at steps S330, S400, and S500, the shortest mismatch distance is selected at step S375.

Since each calculation mode is conducted by respective subroutine stored in the ROM 165 with the color sensors 144, 148 commonly used, the construction can be simplified without increase of components.

Different embodiments of the invention may be made without departing from the spirit and scope, but it is to be understood that the invention is not limited to the above specific embodiments. For example, the sewing machine may be constructed to have another calculation mode in which the differentiating calculations are omitted in order to reduce the processing time for such patterns having no longitudinal (with respect to the feeding direction) stripes. The smoothing processing may be also omitted to reduce the processing time for patterns having sharp brightness differences. The machine may further have a function in which if the calculated mismatch distance amount exceeds a predetermined tolerance value, then error is indicated to the operator and the mode is automatically changed to the next mode. The machine may further have a construction in which the mismatch distance is always displayed on the console panel for the operator's convenience.

What is claimed is:

1. A sewing machine for sewing two sheets having the same pattern comprising:

first and second feeding means, each for intermittently feeding one of the sheets;

first and second photo-sensing means, each for optically sensing the pattern on one of the sheets during feeding and for generating photo-intensity data;

a plurality of mismatch detecting means, each for calculating a mismatch distance of the patterns on the two sheets using an algorithm different from that of another mismatch detecting means;

a mode selecting means for selecting one of the plurality of mismatch detecting means according to characteristics of the pattern on the two sheets; and a feed-adjusting means that uses the mismatch distance calculated by the selected mismatch detecting means, for adjusting one of the feeding means to match the patterns.

2. A sewing machine, as in claim 1, where each of the first and second photo-sensing means senses the pattern while the sheets are fed for a preset length, and all of the mismatch detecting means calculate the mismatch distance after every feeding of said preset length.

3. A sewing machine, as in claim 1, where each of the photo-intensity data represents brightness of the pattern, and one of the plurality of mismatch detecting means calculates the mismatch distance using the photo-intensity data.

4. A sewing machine, as in claim 1, where each of the first and second photo-sensing means separately generates photo-intensity data of a plurality of different colors.

5. A sewing machine, as in claim 4, where one of the plurality of mismatch detecting means comprises first and second color selection means, each for selecting one of the color intensity data generated by the respective photo-sensing means that has the largest change in the intensity, and the mismatch distance being calculated using the selected color intensity data.

6. A sewing machine, as in claim 4, where one of the plurality of mismatch detecting means comprises first and second subtracting means, each for calculating differences between the intensity data of different colors generated by the respective photo-sensing means, and the mismatch distance being calculated using the differences.

7. A sewing machine, as in claim 1, where the mode selecting means comprises a selection switch by which an operator of the sewing machine selects one of the mismatch detecting means.

8. A sewing machine, as in claim 1, where the mode selecting means comprises a determining means for determining one of the selected mismatch detecting means that generates the smallest mismatch distance, by which the feed-adjusting means adjusts one of the feeding means.

9. A sewing machine for sewing two sheets having a same pattern comprising:

first and second feeding means, each for intermittently feeding one of the sheets;

first and second photo-sensing means each for optically sensing the pattern on one of the sheets during feeding and for generating photo-intensity data of red, green and blue colors for a plurality of points on the sheet;

a plurality of mismatch detecting means, each for calculating a mismatch distance of the patterns on the two sheets using an algorithm different from that of another mismatch detecting means;

a mode selecting means for selecting one of the plurality of mismatch detecting means according to characteristics of the pattern n the two sheets; and a feed-adjusting means that uses the mismatch distance calculated by the selected mismatch detecting means, for adjusting one of the feeding means to match the patterns.

10. A sewing machine, as in claim 9, where one of the plurality of mismatch detecting means comprises:

first and second totaling means, each for totaling the red, blue, and green color photo-intensity data generated by the respective photo-sensing means;

first and second averaging means, each for averaging the respective totaled data, the averaging for each point being performed by first adding values of data for several points before and after the point to the value of data at that point, and then dividing the sum by the number of the points added together; and first and second differentiating means, each for differentiating the respective averaged data, by which the mismatch distance is calculated.

11. The sewing machine, as in claim 9, where one of the plurality of mismatch detecting means comprises:

first through sixth averaging means, each for averaging one of the photo-intensity data of the three colors for the first and second photo-sensing means, the averaging for each point being performed by first adding values of data for several points before and after the point to the value of data at that point, and then dividing the sum by the number of the points added together;

first through sixth differentiating means, each for differentiating the respective averaged data;

first through sixth peak amplitude detecting means, each for detecting a peak-to-peak amplitude for each of the respective differentiated data; and a color selecting means for selecting the color that has the largest peak-to-peak amplitude of the two sheets, by which the mismatch distance is calculated.

12. The sewing machine, as in claim 9, where one of the plurality of mismatch detecting means comprises:

first through sixth subtracting means, each for calculating a difference between two of the photo-intensity data within one of the first and second photo-sensing means;

first through sixth averaging means, each for averaging the respective difference data, the averaging for each point being performed by first adding values of data for several points before and after the point to the value of data at that point, and then dividing the sum by the number of the points added together;

first through sixth featuring means, each for calculating a featuring difference which is a difference between the respective difference calculated by the subtracting means and the respective averaged difference calculated by the averaging means; and first and second totaling means, each for totaling the three featuring differences corresponding to a respective sheet, by which the mismatch distance is calculated.

13. The sewing machine, as in claim 9, where the mode selecting means comprises a selection switch by which an operator of the sewing machine selects one of the mismatch detecting means.

14. The sewing machine, as in claim 9, where the mode selecting means comprises a determining means for determining one of the selected mismatch detecting means that generates the smallest mismatch distance, by which the feed-adjusting means adjusts one of the feeding means.

* * * * *